US006488569B1

(12) United States Patent
Wang et al.

(10) Patent No.: US 6,488,569 B1
(45) Date of Patent: Dec. 3, 2002

(54) METHOD AND APPARATUS FOR DETECTING MICRO-SCRATCHES IN SEMICONDUCTOR WAFERS DURING POLISHING PROCESS

(75) Inventors: Hsu-Pin Wang, Tallahassee, FL (US); Qing Liu, Tallahassee, FL (US)

(73) Assignee: Florida State University, Tallahassee, FL (US)

( * ) Notice: Subject to any disclaimer, the term of this patent is extended or adjusted under 35 U.S.C. 154(b) by 91 days.

(21) Appl. No.: 09/619,143

(22) Filed: Jul. 19, 2000

Related U.S. Application Data

(60) Provisional application No. 60/145,383, filed on Jul. 23, 1999.

(51) Int. Cl.[7] ..... B24B 49/00; B24B 1/00

(52) U.S. Cl. ..... 451/8; 451/10; 451/41; 451/287

(58) Field of Search ..... 451/5, 8, 10, 41, 451/285–290

(56) References Cited

U.S. PATENT DOCUMENTS

| | | | | |
|---|---|---|---|---|
| 4,501,149 A | | 2/1985 | Konno et al. | |
| 5,014,547 A | | 5/1991 | Holroyd | |
| 5,036,015 A | | 7/1991 | Sandhu et al. | |
| 5,240,552 A | | 8/1993 | Yu et al. | |
| 5,245,796 A | | 9/1993 | Miller et al. | |
| 5,399,234 A | | 3/1995 | Yu et al. | |
| 5,439,551 A | * | 8/1995 | Meikle et al. | 216/84 |
| 5,469,742 A | | 11/1995 | Lee et al. | |
| 5,514,245 A | | 5/1996 | Doan et al. | |
| 5,605,487 A | | 2/1997 | Hileman et al. | |
| 5,609,718 A | | 3/1997 | Meikle | |
| 5,801,066 A | | 9/1998 | Meikle | |
| 5,996,415 A | * | 12/1999 | Stanke et al. | 374/119 |
| 6,026,688 A | * | 2/2000 | Khuri-Yakub et al. | 374/119 |
| 6,045,434 A | * | 4/2000 | Fisher et al. | 451/10 |

* cited by examiner

*Primary Examiner*—M. Rachuba
(74) *Attorney, Agent, or Firm*—Thompson Coburn LLP

(57) ABSTRACT

An apparatus for planarizing semiconductor wafers in a chemical-mechanical planarization process comprises a polishing pad, a wafer carrier, and at least one acoustic sensor for receiving acoustic emissions produced during the chemical-mechanical planarization process. The wafer carrier is positioned adjacent the polishing pad and is adapted for carrying a wafer in a manner so that the wafer engages the polishing pad. The wafer carrier and the polishing pad are moveable relative to one another in a manner to planarize the wafer. The acoustic sensor is mounted to the wafer carrier in a manner so that the sensor is in contact with the wafer. The acoustic sensor receives acoustic emissions produced during a chemical-mechanical planarization process. The received acoustic emissions are then analyzed to identify and determine surface characteristics of the wafer.

19 Claims, 3 Drawing Sheets

METHOD AND APPARATUS FOR DETECTING MICRO-SCRATCHES IN SEMICONDUCTOR WAFERS DURING POLISHING PROCESS

The benefit of U.S. Provisional Application Ser. No. 60/145,383, filed Jul. 23, 1999, is hereby claimed.

BACKGROUND OF THE INVENTION

This invention relates to semiconductor wafer manufacturing and, more particularly, to a novel method and apparatus for detecting defects and other surface characteristics of a semiconductor wafer during a planarization (polishing) process.

With ever increasing demand from customers, the semiconductor industry is developing processes for producing smaller, better, faster and more affordable microprocessing devices. One step in a conventional semiconductor wafer fabricating process is a polishing or "planarizing" step to produce a flat, smooth and defect-free surface on one face of the semiconductor wafer. The condition of the wafer surface is critical because circuits embedded in the wafer may require resolution of as little as 0.01–0.05 microns. Uniformity of thickness of the wafer is also important, and total thickness variation in the wafer is a critical indicator of the quality of the wafer.

In recent years, chemical-mechanical planarization (CMP) has emerged as the primary technique for planarizing (polishing) semiconductor wafers. CMP is a process of smoothing and planing aided by chemical reactions and mechanical forces. In a typical CMP process, a semiconductor wafer is pressed against a polishing slurry on a polishing pad under controlled chemical, pressure, velocity, and temperature conditions. The polishing slurry solution typically contains small abrasive particles, such as silica or alumina, that mechanically remove the surface of the wafer, and also contains chemicals that react with the material of the wafer to enhance the removal of layers on the surface of the wafer. The polishing pad is a generally planar pad made from a relatively soft porous material, such as blown polyurethane. The polishing pad is typically held in a movable platen that rotates and/or reciprocates the polishing pad. One side of the wafer is typically bonded with a layer of wax (or another suitable bonding agent) to a wafer carrier, which holds the opposite side of the wafer against the polishing slurry on the polishing pad. The platen and the wafer carrier are then moved relative to one another under controlled conditions for a specified period of time to polish or planarize the wafer. Thus, under normal conditions, CMP is a combination of chemical reaction, which serves to loosen material on the wafer surface and help to dissolve them, and free abrasive grinding, in which the abrasives are moved in a rotating motion between the wafer surface and the polishing pad to remove the material on top layers of the wafer by fracturing pieces off the wafer surface (i.e., "micro indentation") into the slurry where they dissolve and are swept away.

The desire for improved yield (acceptance rate) in the semiconductor wafer fabricating process has created a need for improved techniques of in-situ CMP process monitoring and defect detection. One type of critical defect that can occur in a CMP process is "micro-scratching." Micro-scratches can occur during the CMP process when a particle (an unusually large particle in particular) is dragged across the wafer surface. This causes a depression in the top layers of the wafer surface (i.e., a "micro-scratch") that can have a variety of sizes and geometries, but are typically not visible to the naked eye. The particles may be the result of chained slurry abrasives or other foreign objects that find their way between the wafer surface and the polishing pad.

It is desirable that such micro-scratches and other surface defects be detected as early as possible during the CMP operation so that the process can be controlled to correct the problem before more micro-scratches are formed and more wafers irreparably damaged.

SUMMARY OF THE INVENTION

Among the several objects of the invention may be noted the provision of an improved apparatus and method for polishing or planarizing semiconductor wafers; the provision of an apparatus and method for detecting mirco-scratches and other surface defects in semiconductor wafers during the CMP process; the provision of an apparatus and method for analyzing acoustic emissions that result from the CMP process as a means for identifying mirco-scratches and other surface defects in semiconductor wafers; the provision of an apparatus and method employing sensors mounted adjacent to the semiconductor wafer for receiving acoustic emissions resulting from the CMP process; the provision of an apparatus and method for detecting mirco-scratches and other surface defects in semiconductor wafers early in the CMP process so that subsequent damage can be avoided; and the provision of an apparatus and method for analyzing acoustic emissions that result from the CMP process as a means for determining a thickness or end point of the wafer for in-process monitoring of the CMP process.

In general, a planarizing apparatus of the present invention for planarizing semiconductor wafers in a chemical-mechanical planarization process comprises a polishing pad, a wafer carrier, and at least one acoustic sensor for receiving acoustic emissions produced during the chemical-mechanical planarization process. The wafer carrier is positioned adjacent the polishing pad and is adapted for carrying a wafer in a manner so that the wafer engages the polishing pad. The wafer carrier and the polishing pad are moveable relative to one another in a manner to planarize the wafer. The acoustic sensor is mounted to the wafer carrier in a manner so that the sensor is in contact with the wafer.

In another aspect of the present invention, a method for determining surface characteristics of a semiconductor wafer during a chemical-mechanical planarization process comprises planarizing a semiconductor wafer, receiving acoustic emissions produced during the chemical-mechanical planarization process, and analyzing the received acoustic emissions to determine surface characteristics of the wafer.

In still another aspect of the present invention, a method of chemical-mechanical planarization comprises providing a planarizer including a polishing pad, a semiconductor wafer carrier, and at least one acoustic sensor, attaching a semiconductor wafer to the wafer carrier in a manner so that the wafer is engageable with the polishing pad, moving the polishing pad and the wafer carrier relative to one another to planarize the wafer, receiving acoustic emissions produced during the chemical-mechanical planarization process with said acoustic sensor, and analyzing the received acoustic emissions to determine surface characteristics of the wafer being planarized.

While the principal advantages and features of the present invention have been described above, a more complete and thorough understanding and appreciation for the invention may be attained by referring to the drawings and detailed description of the preferred embodiments, which follow.

BRIEF DESCRIPTION OF THE DRAWINGS

Reference characters in the written specification indicate corresponding parts throughout the several views of the drawings.

DETAILED DESCRIPTION OF THE PREFERRED EMBODIMENTS

Figure 1:
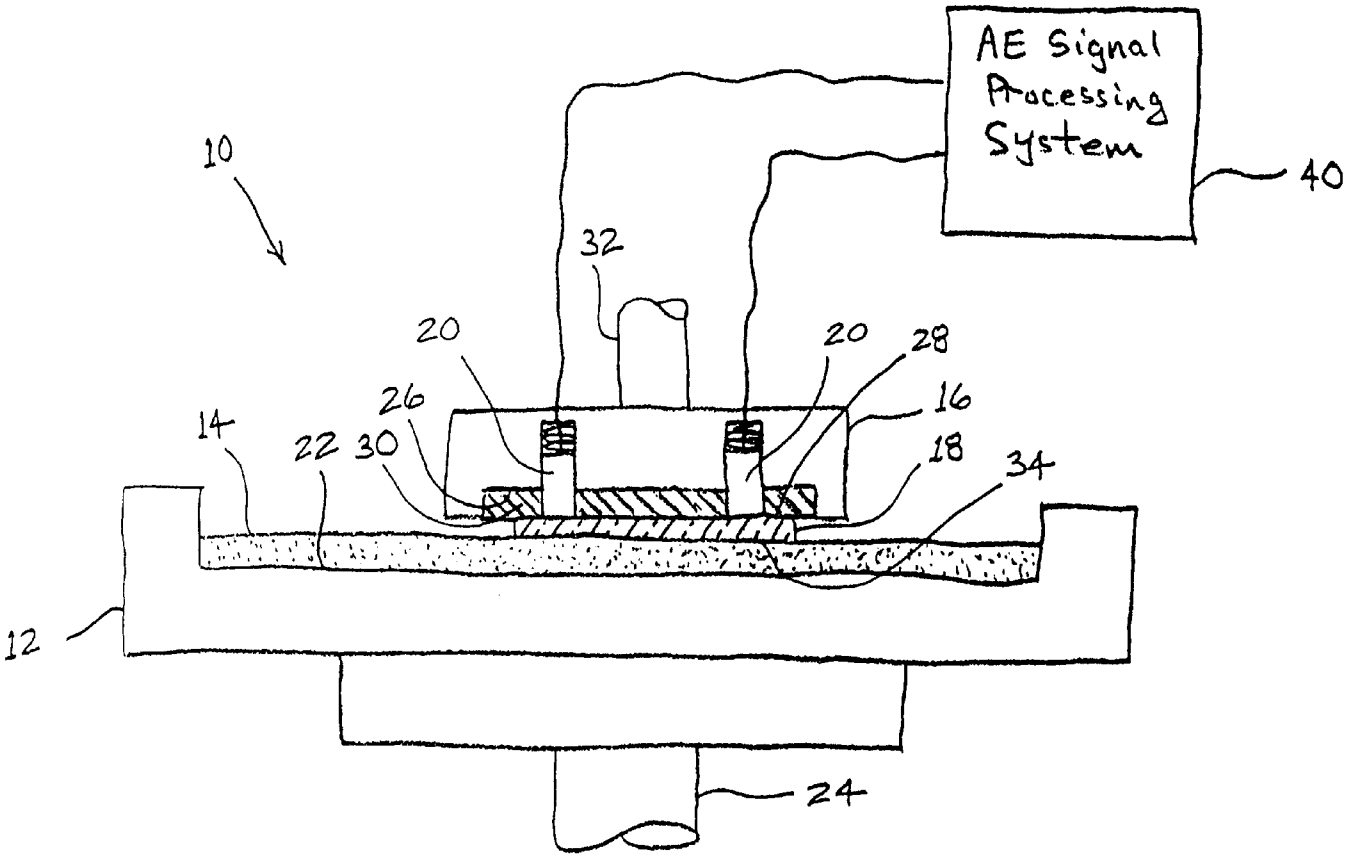
FIG. 1 is a schematic, partial cross-sectional view of a chemical-mechanical planarization apparatus of the present invention.

A planarizing apparatus of the present invention for use in a chemical-mechanical planarization (CMP) process is represented generally by the reference numeral 10 in the schematical drawing of FIG. 1. In general, the planarizing apparatus 10 includes a moveable platen 12, a polishing pad 14 held in the platen, a moveable wafer carrier 16 for carrying a semiconductor wafer 18, a plurality of acoustic sensors 20 for receiving acoustic emissions produced during the chemical-mechanical planarization process, and a signal processing system 40.

The platen 12 has an upper surface 22 upon which the polishing pad 14 is positioned. A drive assembly 24 rotates and/or reciprocates the platen 12 generally in a horizontal plane. The motion of the platen 12 is imparted to the polishing pad 14 held thereon. Preferably, the polishing pad 14 has a generally planar upper surface and is made from blown polyurethane or another suitable relatively soft porous material.

The wafer carrier 16 has a lower surface 26 to which the semiconductor wafer 18 may be attached. A top side 28 of the wafer 18 may be bonded to the lower surface 26 of the wafer carrier 16 with a mounting element 30 comprising a layer of wax, a resilient pad, or another suitable bonding element for frictionally holding the wafer 18 to the wafer carrier 16. Alternatively, the top side 28 of the wafer 18 may be held to the lower surface 26 of the wafer carrier 16 by a vacuum. The wafer carrier may have a drive assembly 32 for rotating and/or reciprocating the wafer carrier 16 generally in a horizontal plane parallel to the movement of the platen 12. The wafer carrier 16 is positioned relative to the platen 12 so that a bottom side 34 of the wafer 18 is held against the polishing pad 14. In operation of the planarizing apparatus 10, one or both of the drive assemblies 24 and 32 are operated to move the platen 12 and the wafer carrier 16 relative to one another to thereby move the bottom side 34 of the wafer 18 horizontally across the polishing pad 14 to polish or planarize the wafer 18.

Preferably, a polishing slurry (not shown) is provided on the polishing pad 14 to enhance the CMP process. The bottom side 34 of the wafer 18 is pressed against the slurry on the polishing pad 14 under controlled chemical, pressure, velocity, and temperature conditions. Preferably, the slurry is a solution of small abrasive particles, such as silica or alumina, and chemicals. The small abrasive particles mechanically remove the layers at the surface of the bottom side 34 of the wafer 18 and the chemicals react with the material of the wafer 18 to enhance the removal of the wafer material. Thus, during the CMP process, the chemicals in the polishing slurry react with the wafer material to loosen material at the wafer surface and to help dissolve that material. The abrasive particles are moved in a rotating and/or reciprocating motion between the wafer surface and the polishing pad and grind against the wafer surface to mechanically remove material on top layers of the wafer by fracturing pieces off the wafer surface (i.e., "micro indentation") into the slurry where they are dissolved and swept away.

The planarizing apparatus 10 also includes at least one acoustic sensor 20 for receiving acoustic emissions. Acoustic emission is defined by the American Society for Testing and Materials (ASTM) as "a transient elastic stress wave generated by the rapid release of energy from a localized source within a material." In a CMP process, possible sources of acoustic emissions include acoustically active chemical reactions, such as dissolution of abraded material, and mechanical sources, such as abrasive slurry particles moving and grinding against the wafer 18 and the polishing pad 14. Material fracturing off at the surface of the wafer 18 is accompanied by micro-dynamic events, such as crystalline fracture, grain boundary sliding, dissolution, etc., all of which involve the rapid release of energy with the area of the fracturing materials. The released energy generates a transient elastic stress wave that propagates within the wafer 18 and can be detected by the acoustic sensors 20. The generation of the stress wave is called acoustic emission (AE). The AE energy increases with increasing the amount and rate of the micro-dynamic events, e.g., the fracturing off of materials at the surface of the wafer 18.

Under normal conditions in a CMP process, the combination of chemical reaction and mechanical grinding of the abrasives between the surface of the wafer 18 and the polishing pad 14 remove material by micro indentation. However, if a larger abrasive particle penetrates the surface of the polishing pad 14, it may plow through the surface of the wafer more deeply that in the case of ordinary micro indentation. Such larger particles may results from abrasive particles of larger size forming and slides across the wafer surface (e.g., chained slurry abrasives), shedded diamond grits from a conditioning disk, foreign particles from the surrounding environment, etc. These deeper penetrations, and the resulting depressions or scratches left in the wafer surface, are referred as "micro scratching." Because these micro scratches are damaging to the wafer surface, it is desirable to detect them as soon as they occur, or as soon as possible thereafter, before more micro scratches are formed and more wafers damaged. In general, the elastic energy released as a result of micro scratching is much more intense than energy releases from ordinary micro indentation. Accordingly, the transient elastic stress waves generated as a result of micro scratching are more intense than those generated from ordinary micro indentation. These changes in energy level can be determined from the acoustic emissions and, as explained below, can be used as a means for detecting the occurrence of micro scratching or larger particle presence.

An acoustic emission signal (i.e., the transient elastic stress wave generated by energy releases from micro-dynamic events) takes the form of a sinusoidal pulse. In accordance with the present invention, the acoustic sensors 20 are used to receive acoustic emissions resulting from the CMP process, and the amplitude of the AE pulses can be used to detect the occurrence of micro scratching. An "amplitude threshold" is established for the acceptance of AE signals. The amplitude threshold is used to identify which detected energy releases are attributable to micro scratching and which are caused merely by normal fracturing-off or micro indentation occurring in the CMP process. In general, energy releases from micro scratching will result in AE signal pulses having an amplitude higher than the established amplitude threshold, and energy releases from normal fracturing-off or micro indentation occurring in the CMP process (or unrelated background noises) will result in signal pulses having an amplitude lower than the established amplitude threshold. Thus, the amplitude threshold is used to eliminate low-level AE signals caused by the normal CMP process. The threshold is established, and can be adjusted, according to the particular parameters of the CMP process.

In accordance with the present invention, the amplitude threshold is used as a gate and the number of received AE signals exceeding the established amplitude threshold are counted. The rate that the signals are received (i.e., the number of pulses received per unit time) is referred to as the "event rate." An increase in the event rate represents a change in the mechanism of material removal and may represent the occurrence of micro scratching.

The AE characteristics of micro scratches are identified through a statistical analysis of the event rate, the amplitudes of the signals received and the root-mean-square (RMS) of the signals. The AE signal energy (i.e., the elastic energy released during material removal in a CMP process) is closely related to the root-mean-squares of the AE signals (the "AErms"). Thus, the AErms can be statistically described and written as:

$$AErms = \sqrt{\frac{1}{N}\sum_{i=1}^{N}(s_i - s_a)^2}$$

where N is the number of collected AE signal pulses ($s_i$, i=1, 2, . . . , N) and $s_a$ is the average value of the sampled signal. Thus, the event rate describes how many energy releasing events are happening per unit time and the AErms represents the level of energy released during these events. This data is monitored during the CMP process and micro-scratches can be detected by studying changes and increases in the signal energy levels. Because the data is received and monitored in real time (i.e., during the CMP process), micro scratches and other abnormalities can be detected as soon as they occur. Preferably, an alarm is given to alert the operator and the operator can then make adjustments to the process or halt the process to avoid further damage from occurring.

Figure 2:
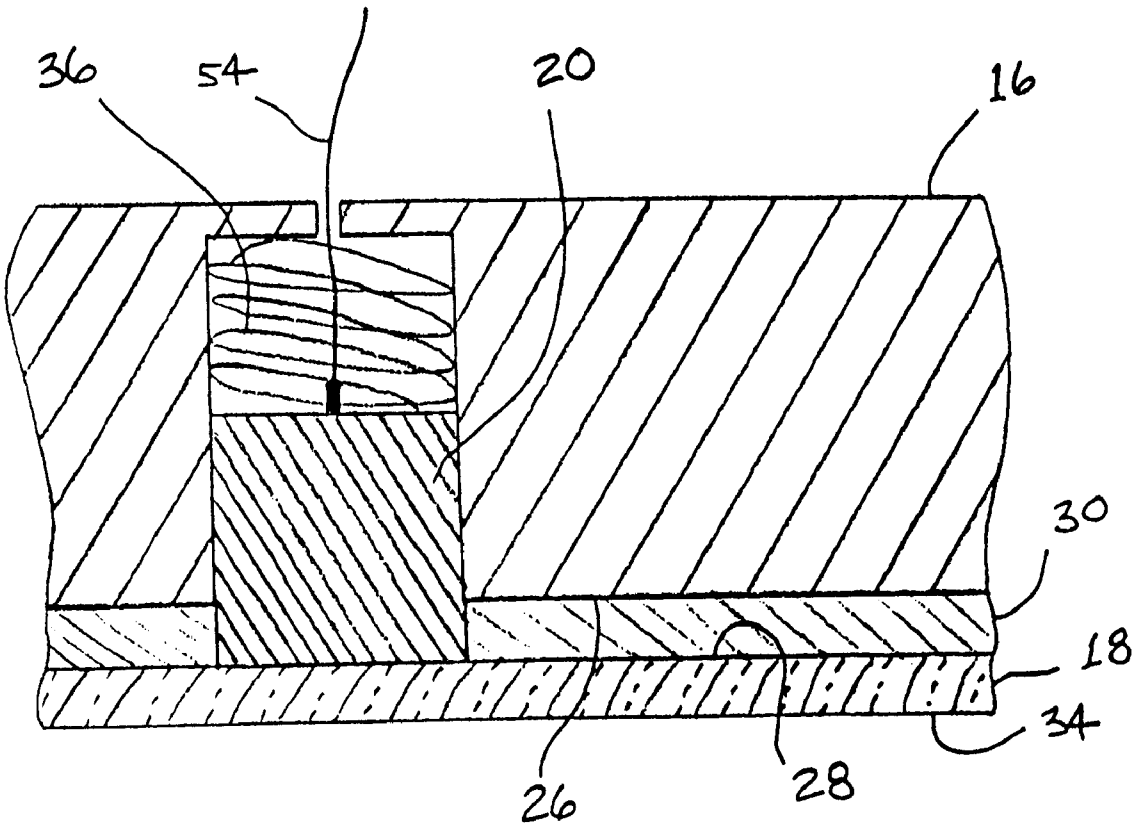
FIG. 2 is an enlarged fragmented view, in partial cross-section, of a wafer carrier of the apparatus of FIG. 1 with an acoustic sensor mounted therein.

As shown in FIGS. 1 and 2, the acoustic sensor 20 is mounted to the wafer carrier 16 in a manner so that the sensor 20 is adjacent the wafer 18. Preferably, the acoustic sensor 20 is of a type similar to a PAC Model S9208 wide band acoustic emission sensor, which is manufactured by Physical Acoustics Corporation. Preferably, the acoustic sensor 20 is held in contact with the top side 28 of the wafer 18 to enhance signal transmission because the transient elastic stress wave generated by released energy propagates through the wafer 18 itself. In the preferred embodiment, a plurality of acoustic sensors 20 are mounted within the wafer carrier 16 and are spaced circumferentially around the wafer carrier 16 so that each is in direct contact with the top side 28 of the wafer 18. For example, a wafer carrier including ten such acoustic sensors 20 would have them spaced 36 degrees from one another about the periphery of the wafer carrier 16. Spacing a plurality of the acoustic sensors 20 in this fashion increases acoustic emission detection robustness.

As shown in FIG. 2, each acoustic sensor 20 is preferably mounted to the wafer carrier 16 in a manner so that the sensor 20 contacts the top side 28 of the wafer 18 with a sensor contact pressure, which is preferably substantially equal to a polishing pad contact pressure, i.e., the pressure between the polishing pad 14 and the wafer 18 during the CMP process. A suitable resilient member 36, e.g., a coil spring, is mounted for engagement with the wafer carrier 16 and the sensor 20 for biasing the sensor 20 toward the wafer 18. Preferably, the resilient member 36 applies a force sufficient to provide a sensor contact pressure substantially equal to the polishing pad contact pressure. In the preferred embodiment, the resiliency of the resilient member 36 is adjustable so that the sensor contact pressure can be adjusted by adjusting the resiliency of the resilient member.

Figure 3:
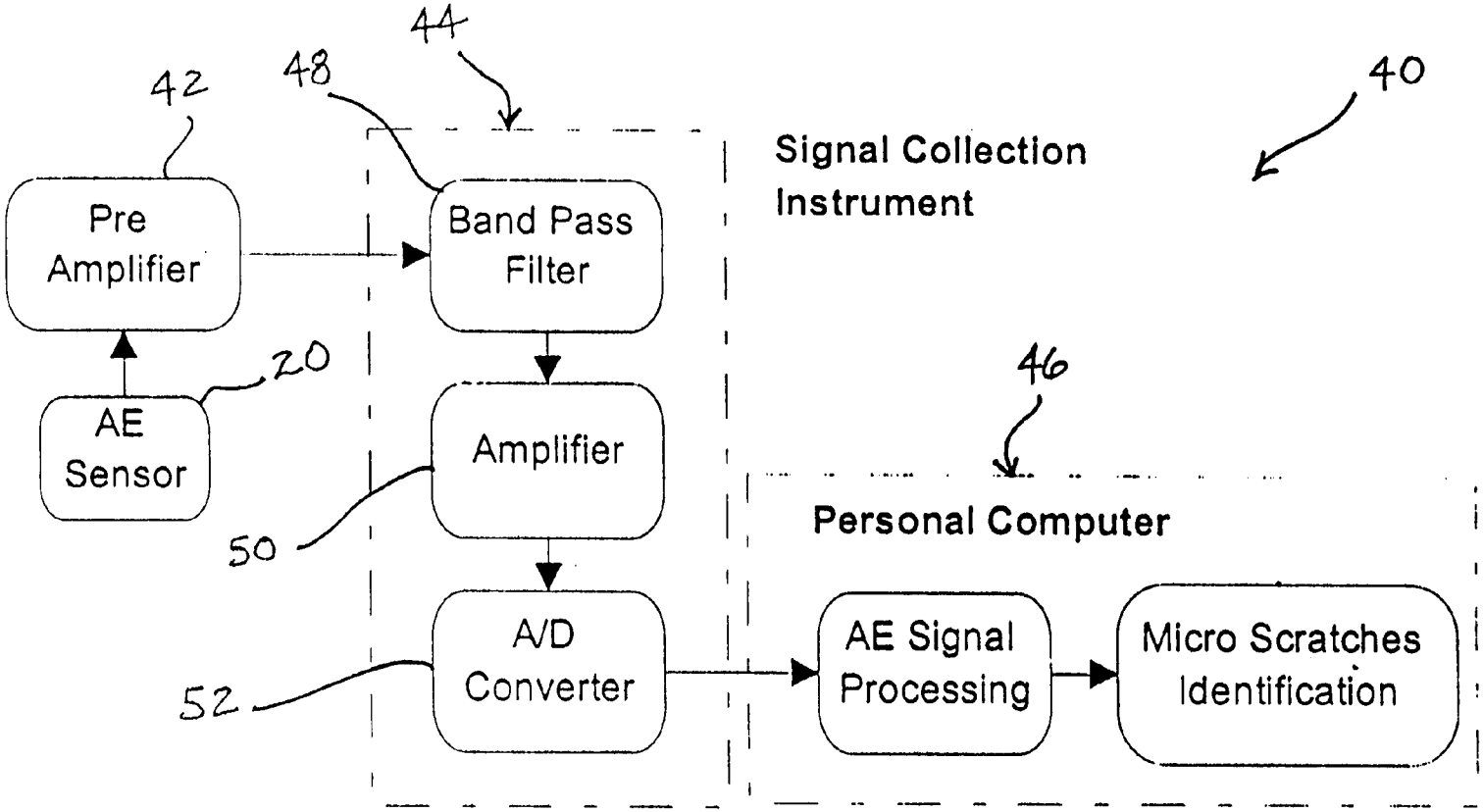
FIG. 3 is a schematic block diagram of an acoustic emission signal processing system used in the apparatus of FIG. 1.

FIG. 3 is a schematic block diagram of an acoustic emission signal processing system, represented generally by the reference numeral 40, which is used in the planarizing apparatus of FIG. 1. As shown in FIG. 3, in the preferred embodiment of the invention, the signal processing system 40 comprises a pre-amplifier 42, a signal collection instrument 44 and a computer 46. Preferably, the signal collection instrument 44 includes a band pass filter 48, an amplifier 50 and an analog to digital converter 52.

Each acoustic sensor 20 translates received acoustic waves into electrical signals, which are conducted through a signal lead 54. The pre-amplifier 42 boosts the electrical signals received from the sensors 20 so that the signals can be further processed without appreciable degradation. The band pass filter 48 is used to eliminate low-frequency components related to background noise and other normal acoustic emissions resulting from micro indentation (the aforementioned amplitude threshold) and also eliminates extra-high-frequency signals, e.g., environmental noise, in order to avoid aliasing error. Optimal upper and lower cutoff frequencies can be determined through experimentation and may depend upon the specific parameters of the CMP process. However, preferably, the lower cutoff frequency is about 50 kHz and the upper cutoff frequency is about 1 MHz. Signals outside of this range are generally not considered to be related to the acoustic emissions in a CMP process.

The amplifier 50 then boosts the signals that are allowed to pass through the band pass filter 48 for further processing. Then, the signals are converted to digital signals by the converter 52 for processing with the computer 46. The computer 46 is used for event counting (i.e., counting AE signals received) and AErms calculation. By analyzing the event rate, the AErms and other CMP parameters, a "signature" or "fingerprint" of the wafer surface is generated. The measured pattern is compared with patterns collected through experiments in CMP processes having known parameters and results. Thus, when a newly measured pattern is similar to a previously measured pattern where micro scratching occurred, an alarm is given to the CMP operator so the operator can make adjustments to the process or halt the process to avoid further damage from occurring.

In a CMP process, a wafer (or a dielectric layer thereof) must be accurately planarized to a desired end point. In addition to micro indentation and micro scratches, AE signals are sensitive to other process conditions and parameters of the CMP process, e.g., wafer surface roughness, polishing pad conditions, loading conditions, slurry concentration, etc. Therefore, in an alternative embodiment of the invention, AE signals may be used as a means for end point detection during the CMP process.

In view of the above, it will be seen that improvements over the prior art have been achieved and other advantageous results attained. As various changes could be made without departing from the scope of the invention, it is intended that all matter contained in the above description or shown in the accompanying drawings shall be interpreted as illustrative and not in a limiting sense. It should be understood that other configurations of the present invention could be constructed, and different uses could be made, without departing from the scope of the invention as set forth in the following claims.

What is claimed is:

1. A planarizer for planarizing semiconductor wafers in a chemical-mechanical planarization process, the apparatus comprising:

a polishing pad;

a wafer carrier positioned adjacent the polishing pad, the wafer carrier being adapted for carrying a wafer in a manner so that the wafer engages the polishing pad, the wafer carrier and the polishing pad being moveable relative to one another in a manner to planarize the wafer; and at least one acoustic sensor for receiving acoustic emissions produced during the chemical-mechanical planarization process, the acoustic sensor being mounted to the wafer carrier in a manner so that the sensor is in contact with the wafer.

2. The planarizer of claim 1 wherein the acoustic sensor is in direct contact with the wafer.

3. The planarizer of claim 1 wherein the wafer carrier is adapted for carrying a wafer in a manner so that a first side of the wafer engages the polishing pad, the acoustic sensor being mounted to the wafer carrier in a manner so that the sensor is in contact with an opposite second side of the wafer.

4. The planarizer of claim 3 wherein the acoustic sensor is mounted to the wafer carrier in a manner so that the sensor contacts the second side of the wafer with a sensor contact pressure, the sensor contact pressure being substantially equal to a polishing pad contact pressure, which is applied to the first side of the wafer by the polishing pad during the chemical-mechanical planarization process.

5. The planarizer of claim 4 further comprising a resilient member in engagement with the wafer carrier and the acoustic sensor for biasing the acoustic sensor toward the second side of the wafer.

6. The planarizer of claim 5 wherein the resiliency of the resilient member is adjustable and wherein the resilient member and the acoustic sensor are mounted to the wafer carrier in a manner so that the sensor contact pressure can be adjusted by adjusting the resiliency of the resilient member.

7. The planarizer of claim 1 comprising a plurality of acoustic sensors.

8. The planarizer of claim 7 wherein said plurality of acoustic sensors are circumferentially spaced around the wafer carrier.

9. The planarizer of claim 1 wherein the acoustic sensor is adapted for translating received acoustic emissions into electrical signals, the planarizer further comprising a signal processor coupled to the acoustic sensor, the signal processor being adapted for processing and analyzing electric signals received from the acoustic sensor.

10. A method for determining surface characteristics of a semiconductor wafer during a chemical-mechanical planarization process, the method comprising:

planarizing a semiconductor wafer;

receiving acoustic emissions produced during the chemical-mechanical planarization process; and analyzing the received acoustic emissions in a manner to detect defects in the wafer being planarized.

11. The method of claim 10 further comprising the step of controlling the planarizing of the wafer in response to the analysis of the received acoustic emissions.

12. The method of claim 10 further comprising the step of positioning at least one acoustic sensor adjacent the semiconductor wafer and wherein the step of receiving acoustic emissions includes receiving acoustic emissions with said at least one acoustic sensor.

13. The method of claim 12 wherein the step of positioning includes positioning said at least one acoustic sensor in direct contact with the semiconductor wafer.

14. The method of claim 10 wherein the step of analyzing the received acoustic emissions includes the step of translating the received acoustic emissions into electrical acoustic emission signals.

15. The method of claim 14 wherein the step of analyzing the received acoustic emissions includes establishing an amplitude threshold for the acoustic emission signals and counting the number of signals that exceed said amplitude threshold.

16. The method of claim 15 wherein the step of analyzing the received acoustic emissions includes monitoring the rate of acoustic emission signals that exceed said amplitude threshold per unit of time.

17. A method of chemical-mechanical planarization comprising:

providing a planarizer including a polishing pad, a semiconductor wafer carrier, and at least one acoustic sensor;

attaching a semiconductor wafer to the wafer carrier in a manner so that the wafer is engageable with the polishing pad;

positioning said at least one acoustic sensor in direct contact with the semiconductor wafer;

moving the polishing pad and the wafer carrier relative to one another to planarize the wafer;

receiving acoustic emissions produced during the chemical-mechanical planarization process with said acoustic sensor; and analyzing the received acoustic emissions to determine surface characteristics of the wafer being planarized.

18. The method of claim 17 wherein the planarizer includes a resilient member in engagement with the wafer carrier and the acoustic sensor for biasing the acoustic sensor against the wafer at a sensor contact pressure.

19. The method of claim 18 further comprising the step of adjusting the resiliency of the resilient member so that the sensor contact pressure is substantially equal to a polishing pad contact pressure applied to the wafer by the polishing pad during the chemical-mechanical planarization process.

* * * * *